US006495933B2

(12) United States Patent
Tokuda et al.

(10) Patent No.: US 6,495,933 B2
(45) Date of Patent: Dec. 17, 2002

(54) POWERED TRAP DOOR DEVICE FOR VEHICLE

(75) Inventors: Kenji Tokuda, Kakogawa (JP); Kunihiko Takagi, Akashi (JP); Masaharu Yagi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 1 day.

(21) Appl. No.: 09/725,546

(22) Filed: Nov. 29, 2000

(65) Prior Publication Data

US 2001/0002775 A1 Jun. 7, 2001

(30) Foreign Application Priority Data

Dec. 1, 1999 (JP) ..... 11-342047

(51) Int. Cl.[7] ..... B60R 27/00
(52) U.S. Cl. ..... 307/326; 307/9.1; 105/426
(58) Field of Search ..... 307/326–328, 307/9.1, 10.1; 105/343, 426–435

(56) References Cited

U.S. PATENT DOCUMENTS 5,154,125 A 10/1992 Renner et al.
6,341,563 B1 * 1/2002 Gal et al. ..... 105/427
6,357,362 B1 * 3/2002 Krbec et al. ..... 105/426

FOREIGN PATENT DOCUMENTS

JP 5-229428 5/1991

* cited by examiner

*Primary Examiner*—Fritz Fleming
(74) *Attorney, Agent, or Firm*—Marshall, Gerstein & Borun

(57) ABSTRACT

A powered trap door device for a vehicle including a trap door hinged at a floor of a vestibule with steps of the vehicle and a sliding vehicle door. A screw driving mechanism that opens/closes the trap door and is driven by an electric motor with an electromagnetic brake. A first limit switch for detecting opening of the sliding door of the vehicle. A second limit switch for detecting closing of the trap door, the trap door being openable only when the sliding door is opened and the sliding door being closable only when the trap door is closed. A sensor of a periphery monitoring system provided on the vestibule to check safety of a peripheral area of the trap door, wherein the trap door can be opened/closed by the electric motor with the electromagnetic brake after the periphery monitoring system has checked safety.

9 Claims, 12 Drawing Sheets

POWERED TRAP DOOR DEVICE FOR VEHICLE

BACKGROUND OF THE INVENTION

1. Field of the Invention

The present invention relates to floor door devices which are opened when vestibules with steps of a vehicle are used to allow passengers to get on and off the vehicle by using the steps, that is, powered trap door devices that are capable of safely and automatically opening/closing all trap doors.

2. Description of the Related Art

When a train stops at a platform almost as high as a floor of a vestibule of the train, passengers can get on and off the train without inconvenience. However, in case of a railway in which a station has no platform, since the difference in height between the vestibule of the vehicle and the ground is large, passengers cannot safely and easily get on and off the train in this state. Accordingly, in order to allow the passengers to safely and easily get on and off the train at such stations, collapsible steps are stored under the floor of the vestibule, and the passengers can get on and off the train through a vestibule entrance by using the steps (see Japanese Laid-Open Patent Publication No. 5-229428). This is advantageous since it is not necessary to make any change to the vestibule. However, the collapsible steps are cumbersome as compared. to fixed steps and take much time to be taken in and out. Besides, safety and reliability of operation of the collapsible steps are considered to be relatively low.

On the other hand, there has been proposed trap doors that open/close openings provided on each floor of vestibules to enable the passengers to get on and off the train by using fixed steps provided under each floor of the vestibules. In actuality, since the trap doors are installed on the vestibules, they are manually opened/closed one by one from the view point of safety. It should be noted that Japan has had no examples described above in the past. Hereinafter, such examples are referred to as a "prior art". The details according to the prior art will be described with reference to FIGS. 1 through 3.

Referring now to FIGS. 1 through 2, a vehicle A with a sliding door D is provided with trap doors T on right and left sides of floors of front and rear vestibules thereof, respectively, and steps R under each floor opening opened/closed by means of the trap door T. The steps R are approximately as high as 1 m.

The trap door T is configured such that one side thereof is fitted at a floor face by means of a hinge and may be opened upwardly and closed when the vestibule is not used. The trap door T constitutes the floor face of the vestibule in a closed condition. When the train stops at a station with a platform, the sliding door D is opened, and then the passengers can go down from the vestibule to the platform. On the other hand, when the train stops at a station with no platform, the sliding door is first opened and then a person (station staff) manually opens the trap door T and engages the trap door T in an opened position by means of a hook or the like. In this state, the passengers can go down to the ground and go into the train by using the steps R.

According to the prior art described above, a person manually opens/closes the trap door T for the sake of safety. Hence, it requires much time and labor to open/close many trap doors T. Accordingly, it is necessary to speedily and automatically open/close the trap doors by total control with safety.

SUMMARY OF THE INVENTION

In view of such circumstances, the present invention is directed to improving an opening/closing mechanism and an opening/closing control system to open/close all trap doors with safety ensured when opening/closing operation of the trap doors is automated.

In one aspect of the present invention, there is provided a powered trap door device for a vehicle including a trap door hinged at a floor of a vestibule with steps of the vehicle, comprising: a screw driving mechanism that opens/closes the trap door and is driven by an electric motor with an electromagnetic brake; a first limit switch for detecting opening of a sliding door of the vehicle; a second limit switch for detecting closing of the trap door, the trap door being openable only when the sliding door is opened and the. sliding door being closable only when the trap door is closed; and a sensor of a periphery monitoring system provided on the vestibule to check safety of a peripheral area of the trap door, wherein the trap door can be opened/closed by the electric motor with the electromagnetic brake after the periphery monitoring system has checked safety.

With such configuration, all the trap doors are opened and closed by means of the screw driving mechanism provided thereon, and the first and second limit switches serve to detect opening of the sliding door of the vehicle and detect closing of the trap door, respectively. Thereby, the trap door can be opened only when the sliding door of the vehicle is opened and the sliding door can be closed only when the trap door is closed. Also, the electric motor with the electromagnetic brake is driven to open/close the trap door, whereby opening/closing operation of all the trap doors can be carried out safely by a train conductor. Consequently, it is possible to open/close all the doors speedily with safety ensured.

In addition, the screw driving mechanism is driven by the electric motor with the electromagnetic brake, which can be activated to reliably hold the trap door in an opened position. Further, in an emergency, the opening/closing operation of the trap door can be stopped immediately in the middle of the opening/closing operation and the trap door can be reliably held in a stopped position. Accordingly, it is not necessary to provide a mechanical engaging mechanism such as hooks for fixing the trap door in a fully opened or closed position, and it is possible to stop the trap door at any arbitrary open angle.

Besides, there is provided a threshold (guide rail) of the sliding door on an upper face of the trap door, for guiding the sliding door to the opened and closed positions. The (first) limit switch for detecting opening of the sliding door of the vehicle serves to detect opening of the sliding door and the (second)limit switch for detecting closing of the trap door serves to detect closing of the trap door. Thereby, since the trap door can be opened only when the sliding door of the vehicle is opened and the sliding door can be closed only when the trap door is closed, the sliding door is first opened and the trap door is then opened, and the trap door is first closed and the sliding door is then closed. In other words, the trap door is not opened while the sliding door is closed and the sliding door is not closed while the trap door is opened.

Consequently, safety of the opening/closing operation of the trap door associated with the opening/closing of the sliding door is ensured.

Furthermore, a plurality of sensors for a periphery monitoring system are provided around an entrance of the vehicle to check safety of a peripheral area of the trap door, and the trap door can be opened/closed by the electric motor with the electromagnetic brake after the periphery monitoring system has checked safety. Thereby, when any passenger is on the vestibules, the trap door is prevented from being opened/closed. Also, when any passenger enters the vestibule while the trap doors are being opened/closed, the opening/closing operation of the trap door is stopped immediately. Consequently, safety of the opening/closing operation of the trap door associated with the passengers' entry into the vestibules is ensured.

Moreover, since the electromagnetic brake is released and activated in association with the start and stop of the electric motor, the trap door is held in the fully opened or closed position and held in a position in the middle of the opening/closing of the trap door by activating the electromagnetic brake of the electric motor. On the other hand, in an emergency, the electromagnetic brake of the electric motor is forcibly released to allow a person to manually open/close the trap door.

Preferably, the electromagnetic brake of the electric motor is of an unexcitation operation type in which the brake is directed to an operating direction by the force derived from a brake spring and is released by the electromagnet against the brake spring.

The electromagnetic brake is normally ON, while it is OFF when the electric motor is activated. Therefore, high safety is obtained.

Preferably, a driving circuit of the electric motor with the electromagnetic brake is provided with an excess current detecting circuit to shut off a driving current of the electric motor when an excess current is detected.

The excess current detecting circuit serves to detect an abnormal current due to an excess load placed when the trap door is operated, and based on this, the driving current of the electric motor with the electromagnetic brake is shut off. Thereby, loss of the electric motor due to an excessively high burn-out current can be avoided.

Preferably, the sensors of the periphery monitoring system are photoelectric switches and infrared ray reflection switches, and based on the detected signals from the sensors, an alarm is raised into the vestibule.

The photoelectric switches and the infrared ray reflection switches enable the system to reliably detect the existence of any person or obstacle when the trap doors are opened/closed. Therefore, the event that the trap doors are opened/closed when any person or obstacle exists on the vestibules can be reliably avoided.

Preferably, the device further comprises auxiliary control switches of the electric motor with the electromagnetic brake which are provided inside and outside of the vehicle for each vestibule.

These auxiliary control switches enable us to open/close the trap doors on particular vestibules individually from the inside or outside of the vehicle.

Preferably, the device further comprises touch switches provided on three sides of a lower face of the trap door, and when any of the touch switches is turned ON, the trap door stops a closing operation and is driven to move to an opened position.

Because no photoelectric switches can be provided on the steps, it is impossible to reliably detect the entry of any passenger into the steps from the vehicle. However, when the trap door is activated and starts to close although a passenger is on the steps, the touch switches provided on the three sides of the lower face of the trap door touch the passenger on the steps and thereby detect the existence of the passenger, and the trap door is stopped and automatically opened. Since these touch switches are ON at a slight touch, the event that any passenger on the steps collides with the lower face of the trap door and gets injured is avoided.

Preferably, a driving circuit of the electric motor with the electromagnetic brake is provided with an excess current detecting circuit to stop a closing operation of the trap door and to drive the trap door to automatically move back to an opened position when an excess current is detected.

In a case where the trap door makes a contact with a person or an object while the trap door is closed, if this is not detected by the touch switches provided on the three sides of the lower face of the trap door, the driving current of the electric motor with electromagnetic brake is greatly increased, which current is detected by the excess current detecting circuit. Hence, the trap door is immediately stopped and then automatically opened. Consequently, any injury or damage caused by the event that the trap door touches a person or an object can be reliably avoided.

While the electric motor with the electromagnetic brake and the screw driving mechanism are adopted as a driving mechanism of the trap door, there may be provided a sector wheel concentric with a pivot of a hinge H provided on the lower face of the trap door, which can be driven by the electric motor with the electromagnetic brake. In this case, also, the same effects are obtained.

Furthermore, the electric motor with the electromagnetic brake and the screw driving mechanism may be replaced with a pneumatic cylinder with a brake. In this case, a brake device may be adapted to lock the pneumatic cylinder pneumatically (the air flow into and from a primary side and a secondary side of the pneumatic cylinder is shut off by valves).

Moreover, for the trap door, any driving mechanism can be adopted so long as it can be stored under the floor of the vestibule of the vehicle with compactness and can be reliably activated and stopped.

As described above, since the driving mechanism provided under the floor of the vestibule is adapted to automatically open/close the trap door, all the trap doors can be opened/closed by operation of a train conductor.

In addition, the periphery monitoring system is adapted to detect the existence of any person or obstacle on the vestibules, and the opening/closing operation of the trap door is controlled based on the detected signals and opening/closing signals of the sliding door. Consequently, danger can be reliably avoided and the passengers can get on and off the train by using the steps without the necessity of manual operation.

Besides, since the trap door is driven by the electric motor with the electromagnetic brake, the driving device and the brake device can be made compact. Moreover, since the electric motor is a direct current motor, its activation torque is high and therefore the electric motor for driving the trap door can be made smaller.

These object, as well as other objects, features and advantages of the invention will become more apparent to those skilled in the art from the following description with reference to the accompanying drawings.

DETAILED DESCRIPTION OF THE PREFERRED EMBODIMENT

In view of the forgoing description of the prior art, an embodiment of the present invention will be described with reference to accompanying drawings.

Figure 1:
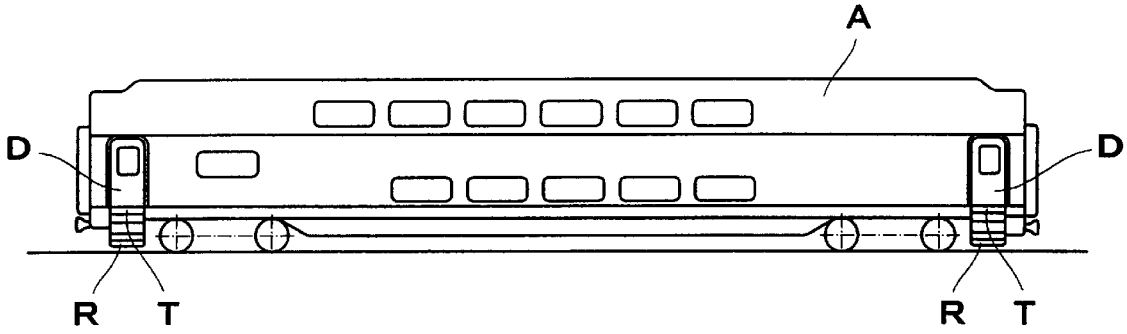
PRIOR ART FIG. 1
FIG. 1 is a side view of a vehicle provided with the conventional trap doors.
Figure 2:
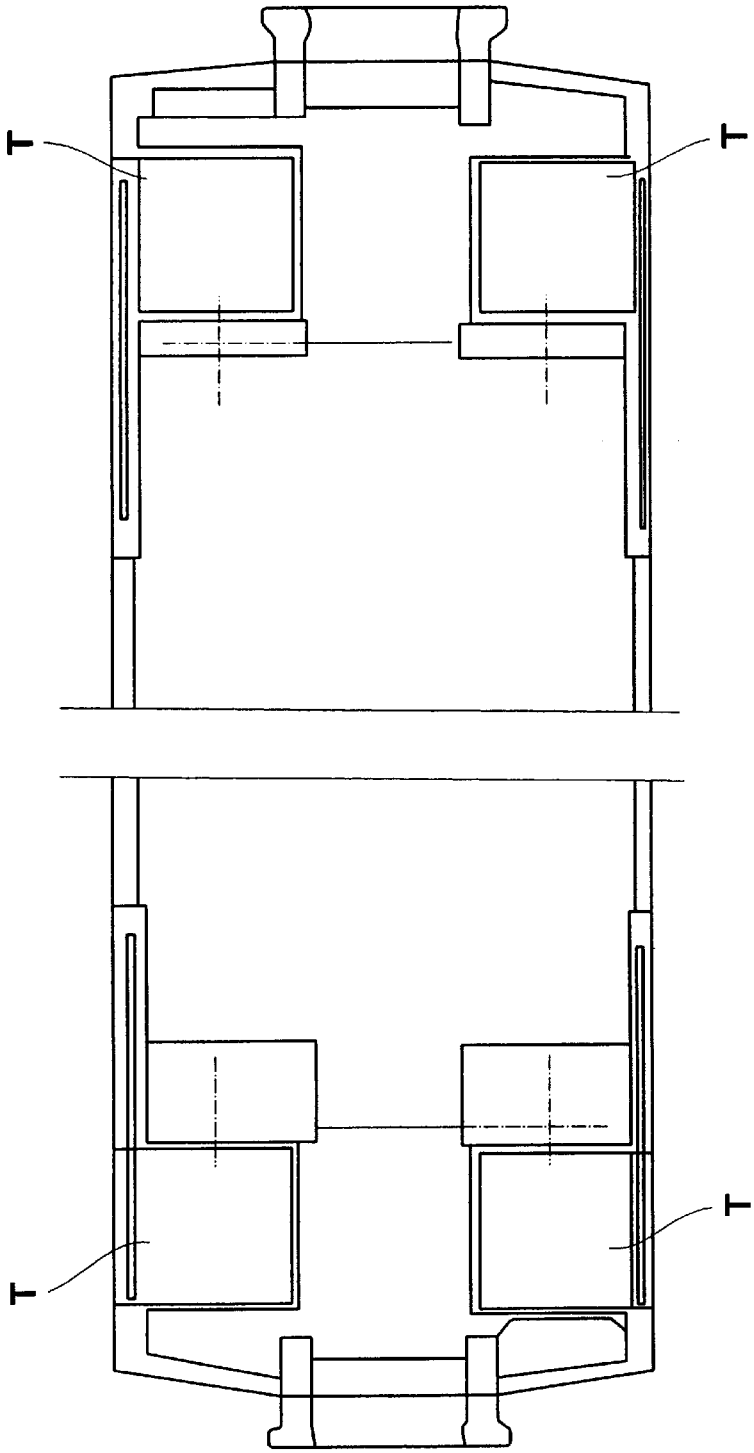
PRIOR ART FIG. 2
FIG. 2 is a plan view showing placement of the conventional trap doors provided on the vehicle.
Figure 3:
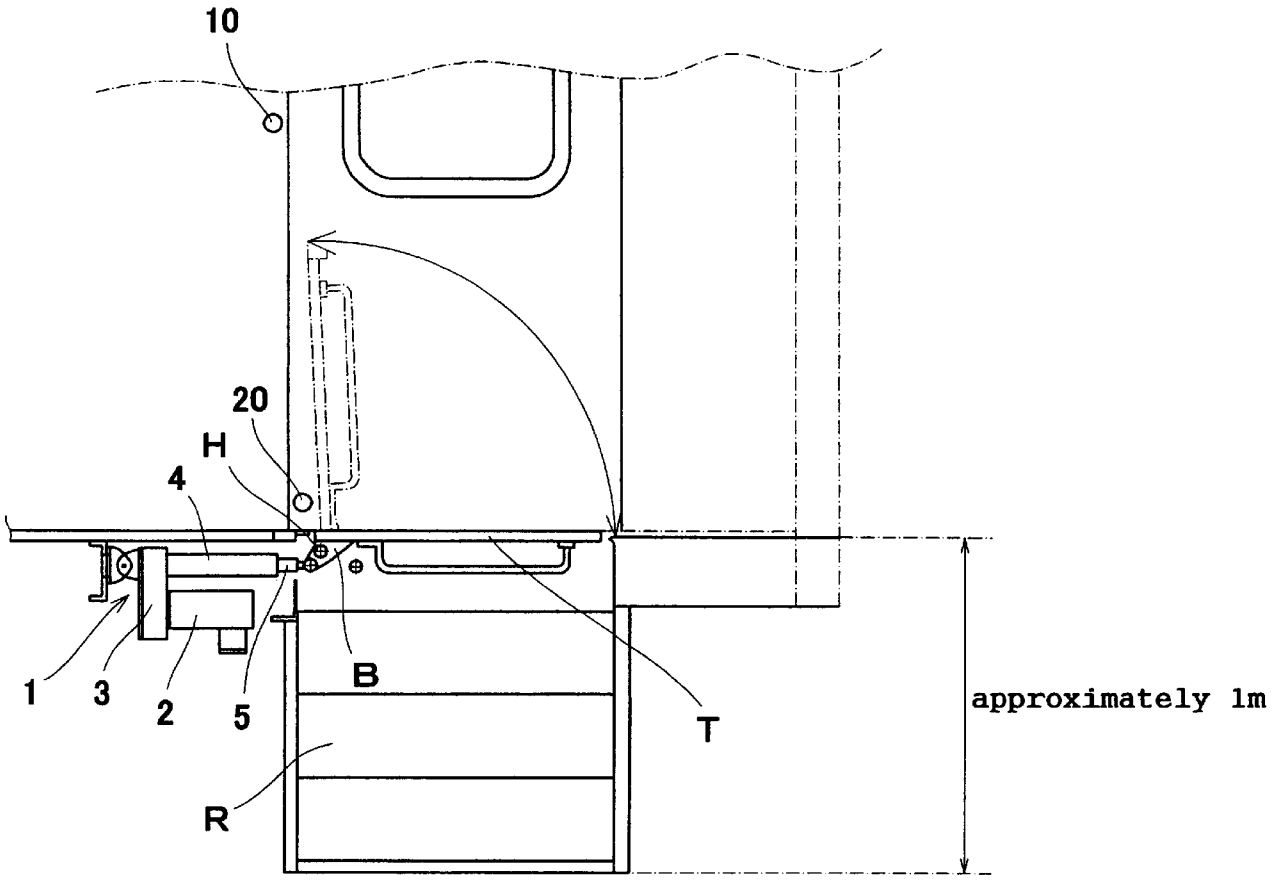
FIG. 3 is a fragmented side view showing a trap door and a driving mechanism thereof according to an embodiment of the present invention.
Figure 4:
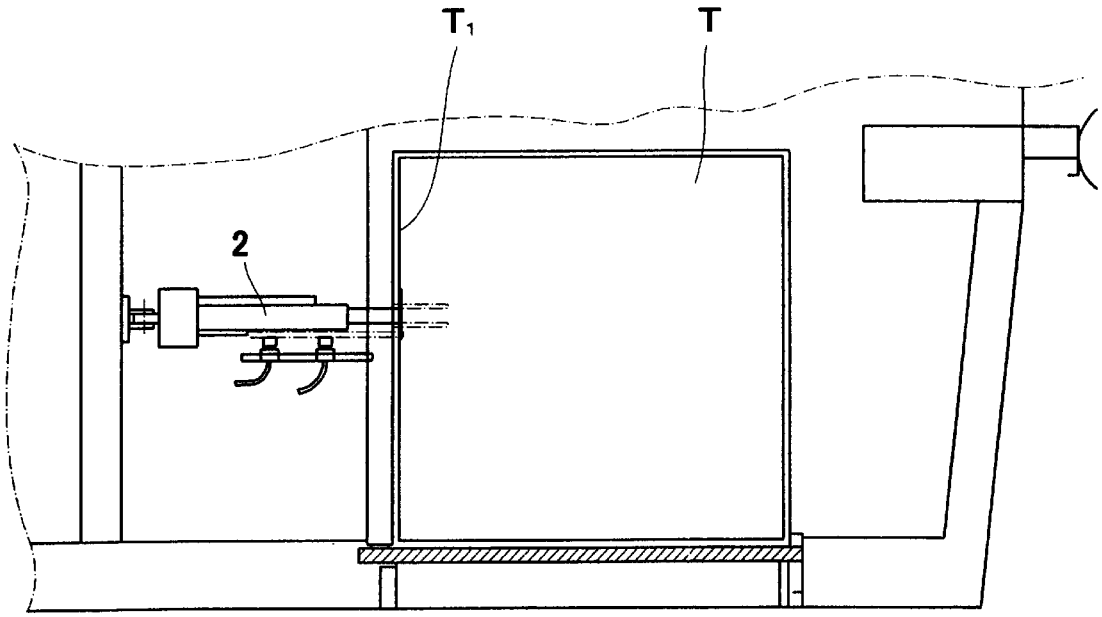
FIG. 4 is a fragmented plan view showing placement of steps and a driving mechanism thereof according to the embodiment of the present invention.

Referring to FIG. 3, an opening (entrance to steps R) having a width of 816 mm and a length of 966 mm is formed on a vestibule of a vehicle behind a sliding door D. A trap door T for opening/closing the opening is connected to a body of the vehicle by means of a hinge H along a side (a side T1 on the left in FIG. 4) thereof. A driving device 1 of the trap door T is provided under a floor of the vehicle. The driving device 1 comprises an electric motor 2 with an electromagnetic brake, a reduction gear 3, and a screw driving mechanism 4. The screw driving mechanism 4 is reciprocally driven by the electric motor 2 with the electromagnetic brake through the reduction gear 3.

Figure 9:
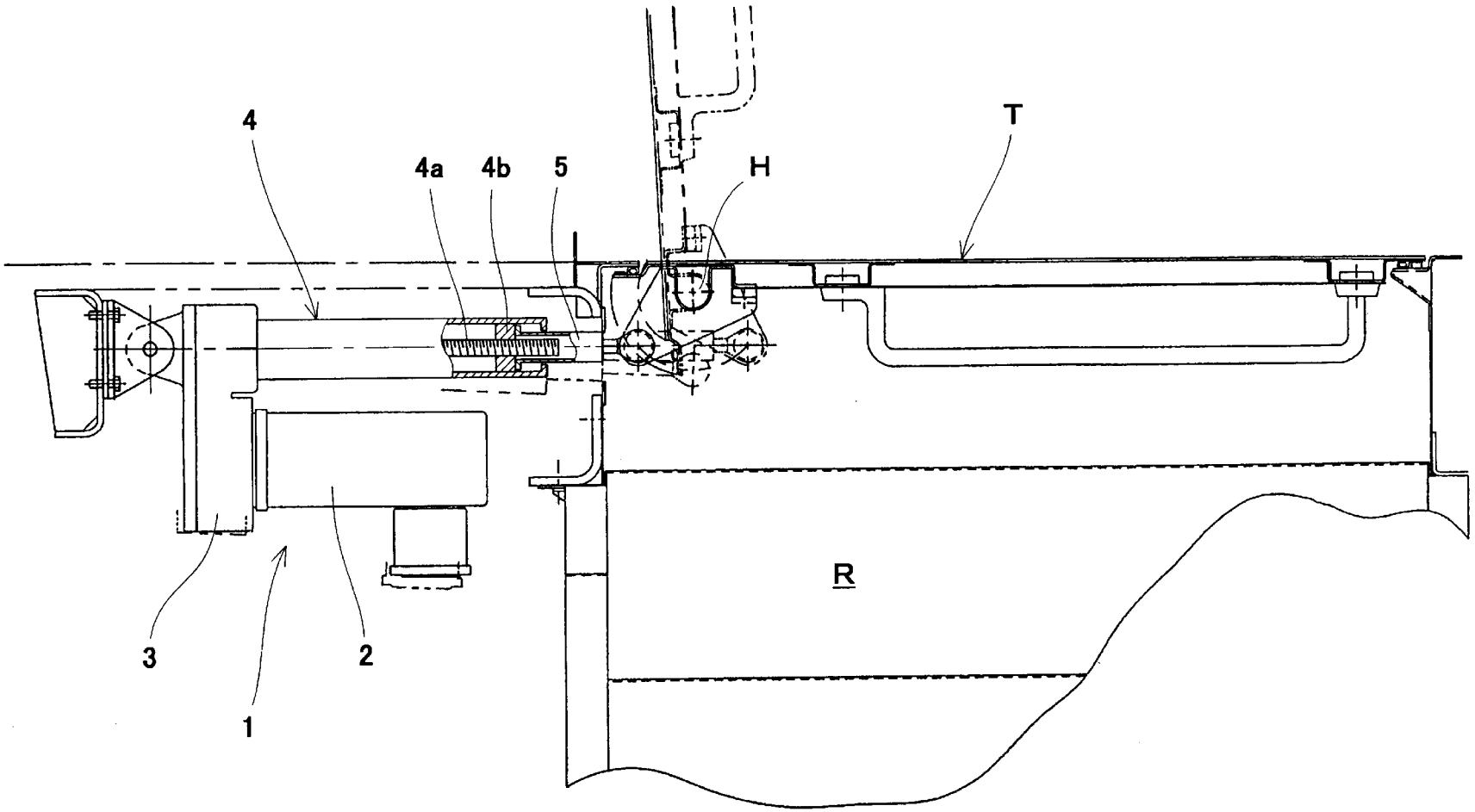
FIG. 9 is an enlarged fragmented view showing a screw driving mechanism of FIG. 3.

A bracket B protruding at the center of a side portion of a lower face of the trap door T as an extension end is connected to a tip end of an extensible rod 5 of the screw driving mechanism 4 by means of pins. The screw driving mechanism 4 includes a conveying screw mechanism in which a threaded shaft 4*a* driven by the reduction gear 3 is threaded into a female screw member 4*b* as seen in FIG. 9. The conveying screw mechanism is stored in an outer cylinder of the screw driving mechanism 4. When the threaded shaft 4*a* is rotated or counter-rotated by the reduction gear 3, the extensible rod 5 is extended/shrunk by the female screw member 4*b*, causing the trap doors T to be fully opened or fully closed using the hinge H as the pivot.

The electromagnetic brake of the electric motor 2 with the electromagnetic brake is held in an operating condition by a brake spring and is released against the brake spring by an electromagnetic actuator when the electric motor is activated (unexcitation operation type). The maximum stroke of the screw driving mechanism 4 is approximately 116 mm and the electric motor has approximately DC74V and 117W. So configured the compact driving mechanism of the trap door is installed under the floor of the vestibule.

A power supply of the electric motor is DC74V and a power supply of a sensor is DC12V. A driving circuit of the electric motor is provided with a thermal relay to detect an excess current of the driving circuit of the electric motor. Thereby, combustion loss of the electric motor due to an excessive burn-out current is avoided.

Figure 10:
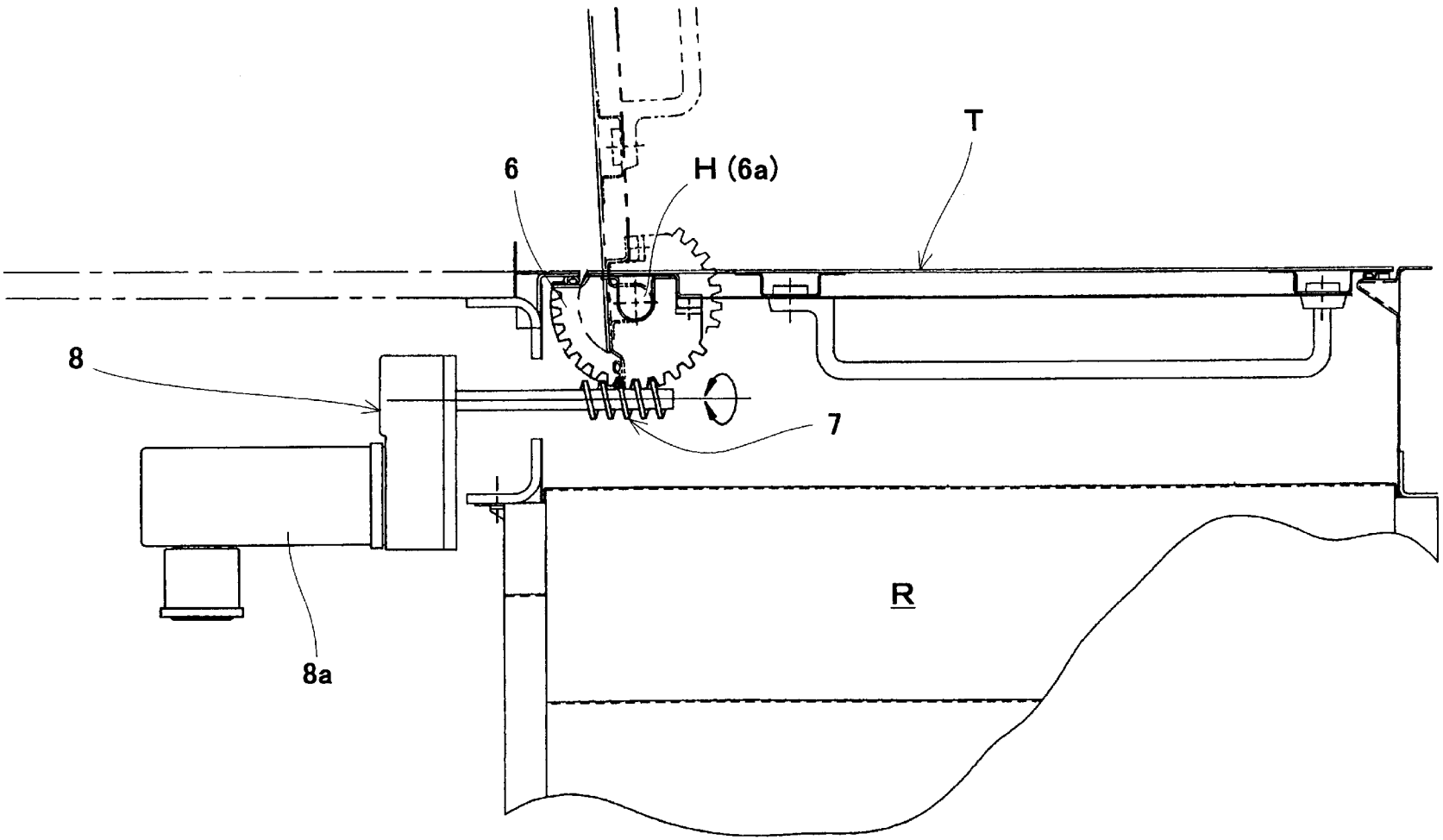
FIG. 10 is a fragmented view showing an alternative gear driving mechanism.

The screw driving mechanism 4 may be replaced by a gear driving mechanism 8 shown in FIG. 10 including a worm wheel (a sector wheel) 6 concentric with a pivot 6*a* of a hinge H that is provided on a lower surface of the trap door T to mesh with a worm gear 7 which is driven to rotate by an electric motor with an electromagnetic brake 8*a* to rotate the worm wheel 6, causing the trap door T to be opened/closed.

Figure 11:
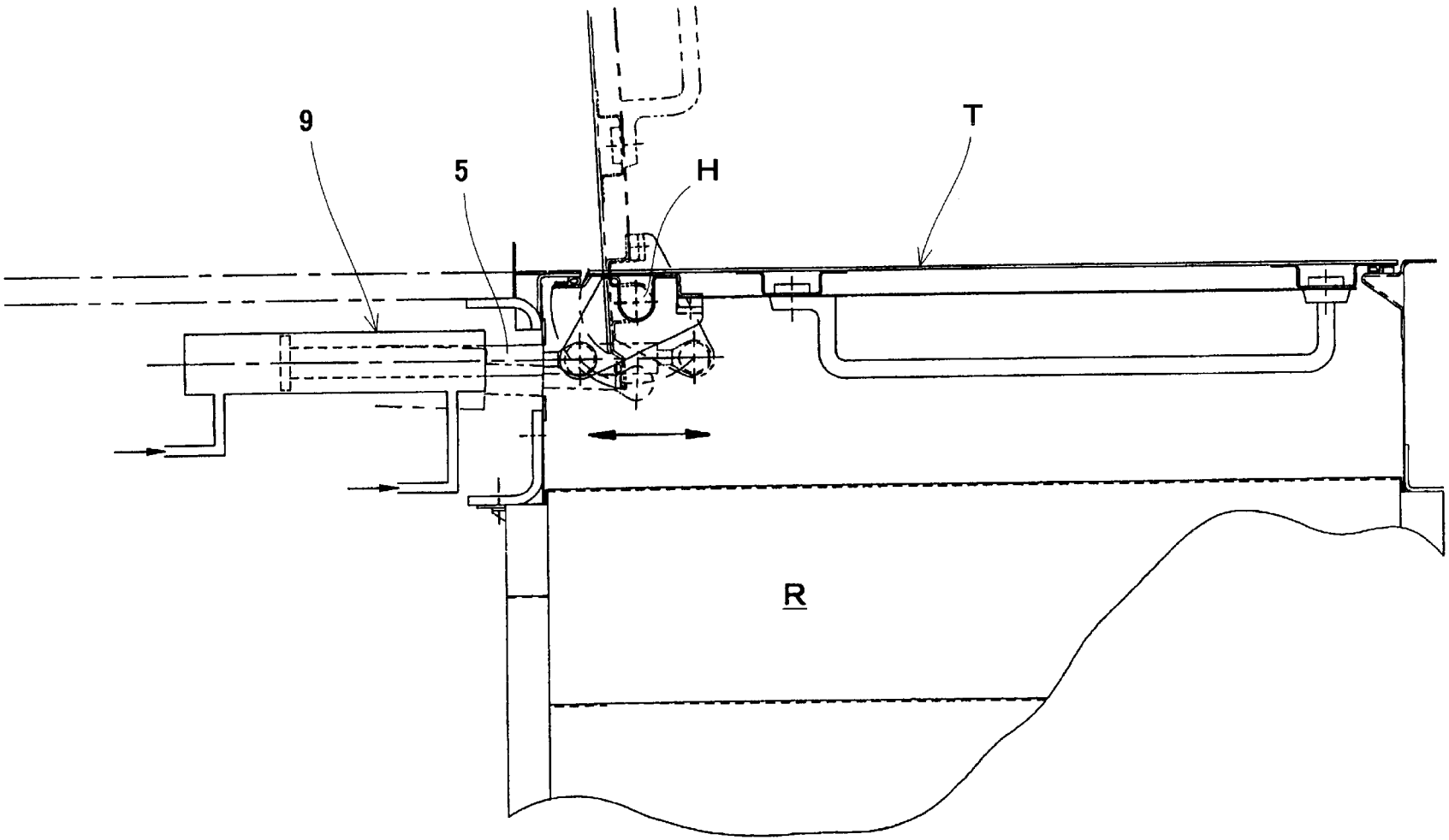
FIG. 11 is a fragmented view showing another alternative pneumatic cylinder mechanism.

Alternatively, the screw driving mechanism 4 may be replaced by a pneumatic cylinder with a brake 9 shown in FIG. 11. In this case, a brake device may be adapted to lock the pneumatic cylinder pneumatically (the air flow into and from a primary side and a secondary side of the pneumatic cylinder is shut off by valves).

An open sensor (contact switch) 10 is provided for the sliding door D and a close sensor (contact switch) 20 is provided for the trap door T to detect corresponding signals.

Figure 5:
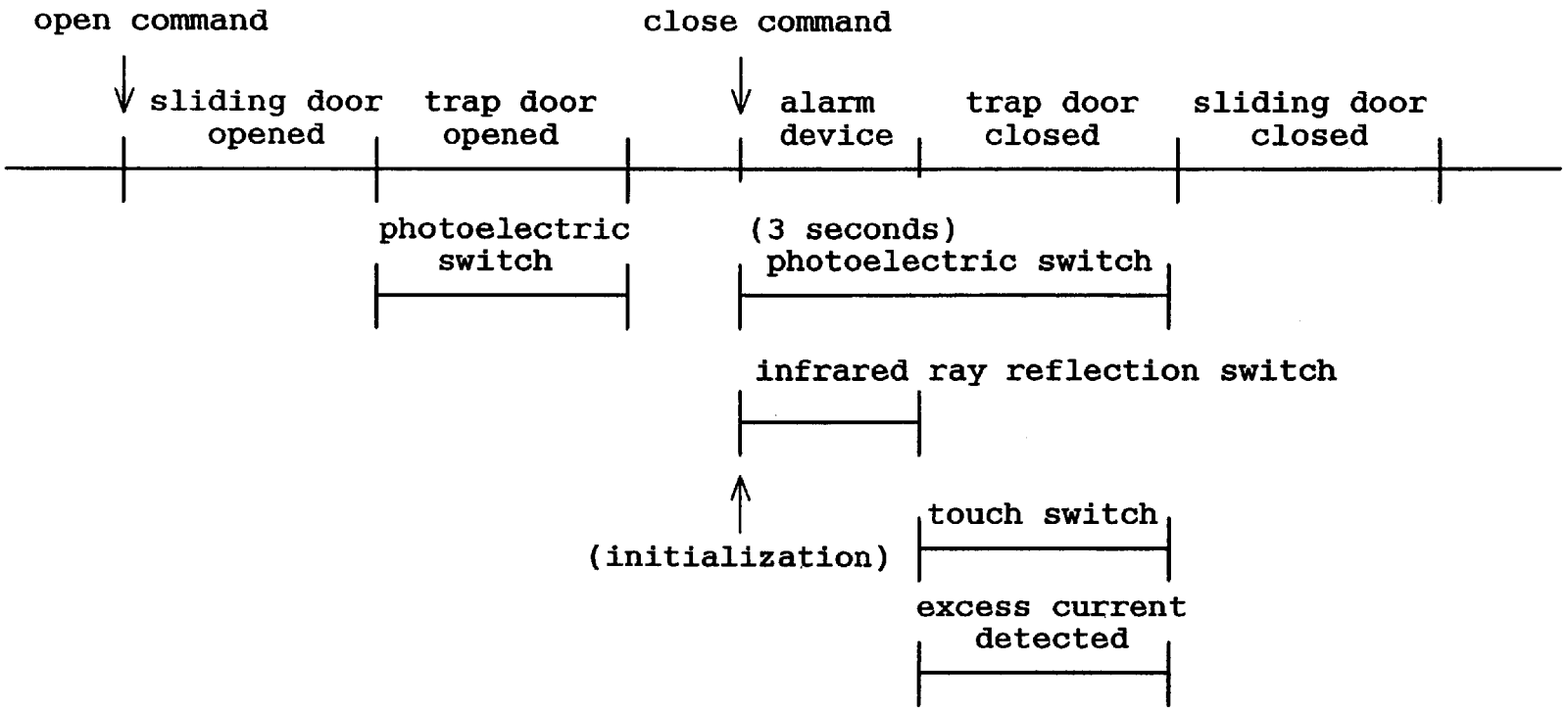
FIG. 5 is an information flow chart showing interlock between automatic opening/closing operation of trap doors and opening/closing operation of a sliding door according to the embodiment of the present invention.

These detected signals are used to associate opening/closing of the sliding door with opening/closing of the trap door to allow the trap door T to be driven by the electric motor with the electromagnetic brake only when the sliding door is opened. The relationship of this interlock is shown in FIG. 5.

Figure 6:
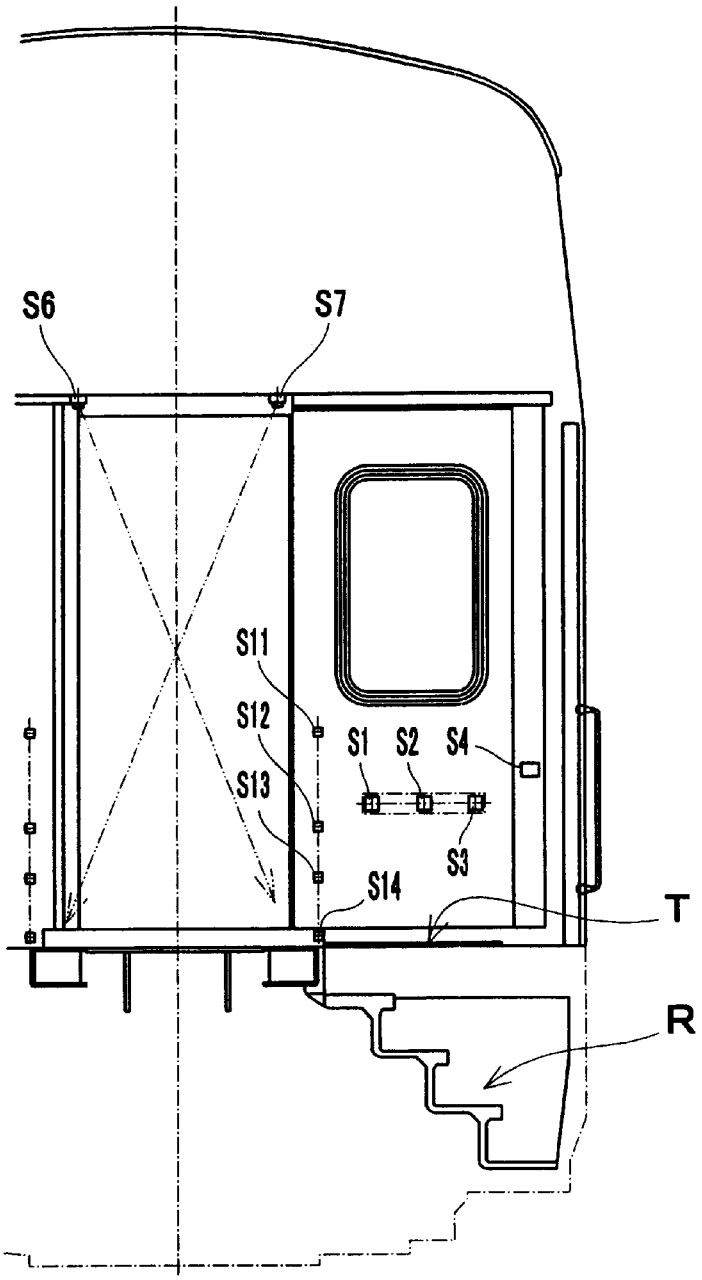
FIG. 6 is a fragmented front view showing placement of various sensors according to the embodiment of the present invention.
Figure 7:
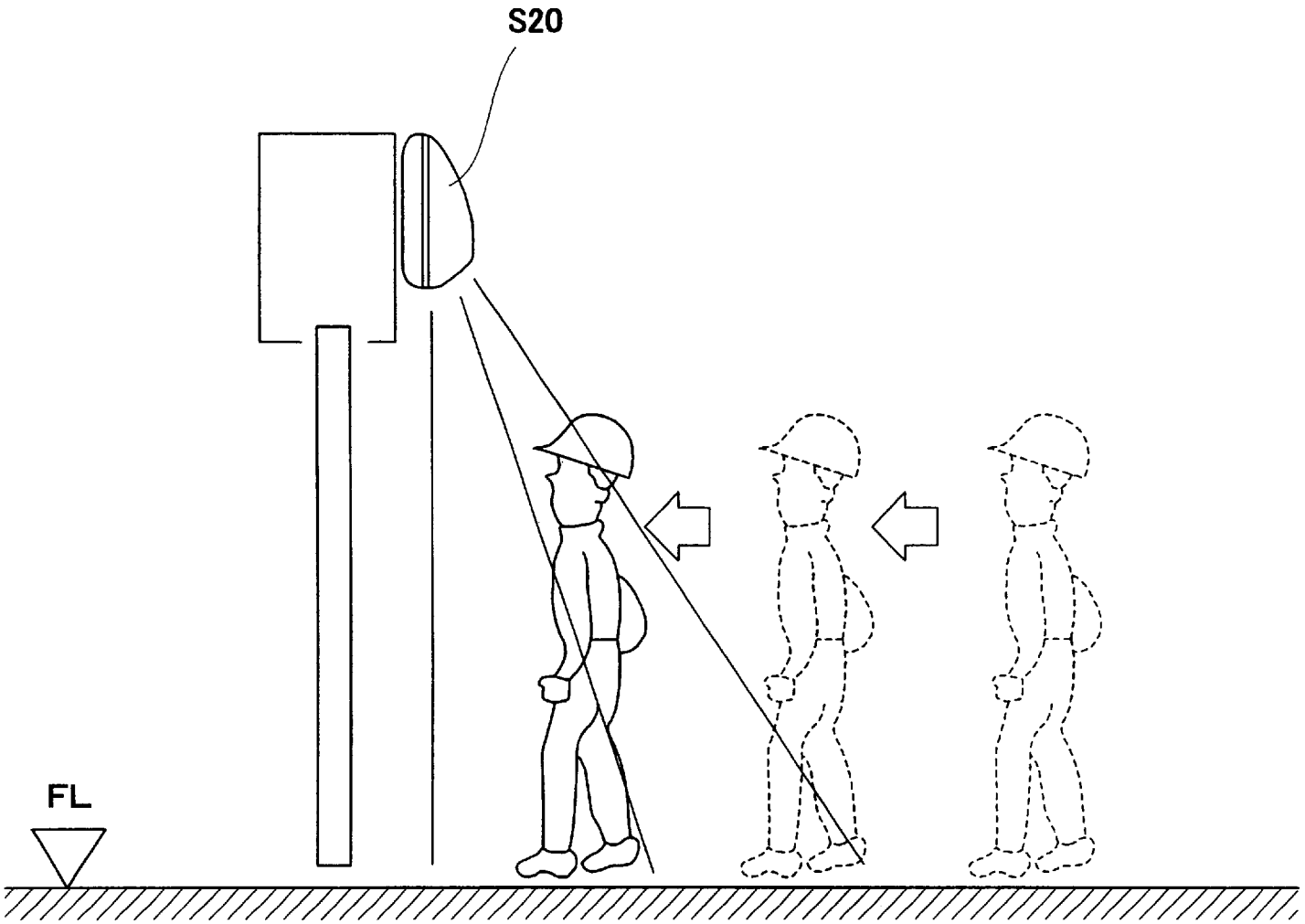
FIG. 7 is a schematic view showing a detecting device using infrared ray reflection switches according to the embodiment of the present invention.

Photoelectric switches and infrared ray reflection switches are provided as necessary to detect the existence of any person or obstacle on the vestibule. By way of example, as shown in FIG. 6, four photoelectric switches S1–S4 may be provided on the trap door side of the vestibule for each trap door, two photoelectric switches S6 and S7 may be provided on an upper part of a central area of the vestibule, four photoelectric switches S11–S14 may be provided at a boundary between the central area of the vestibule and the trap door area, and an infrared ray reflection switch S20 (see FIG. 7) may be provided for each trap door. Also, on a side wall in the vicinity of the trap door of the vestibule, four photoelectric switches may be horizontally aligned in such a manner that they are as high as 500–600 mm and at intervals of 200 mm, two photoelectric switches may be provided at two corners of the upper part of the central area of each vestibule so that beams travel obliquely downward therefrom and cross with each other, and four photoelectric switches may be vertically aligned at the boundary between the central area of the vestibule and the trap door area in such a manner that they are as high as 700–1000 mm and at intervals of 200–300 mm.

These switches reliably detect the existence of any person or obstacle on the vestibules. After it is confirmed that no person or obstacle exists on the vestibule according to the signals detected by these switches, the trap door is opened/closed by the control of the electric motor.

When the existence of any person or obstacle on the vestibule is detected, an alarm device provided on the vestibule raises an alarm to direct them to get off the vestibule.

The infrared ray reflection switches have been well known. The schematic structure of the switches will be described below.

Figure 12:
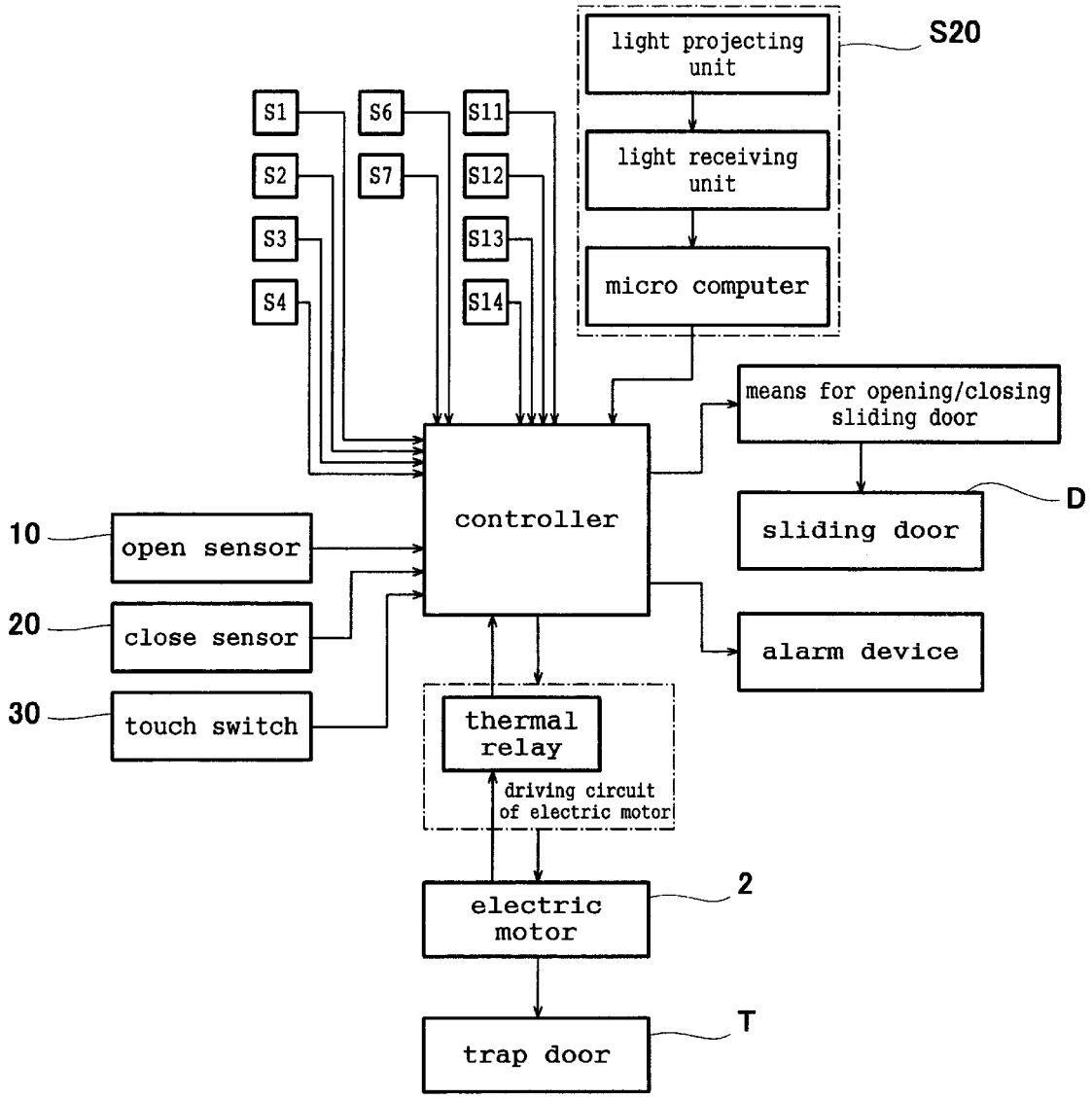
FIG. 12 is a functional block diagram showing a control system of a powered trap door device for a vehicle, relating to an embodiment of the present invention.

A pulse-converted infrared ray is emitted from a light projecting unit and the amount of reflection of the emitted infrared ray is detected by a light receiving unit and converted into a digital signal by a microcomputer, which signal is detected and processed. If a human body or an obstacle enters a detection area, the amount of reflection of the infrared ray changes. Hence, the amount of this change is accurately detected, and it is judged whether or not the person or the obstacle exists in the detection area based on this detected amount of change. Then, the detection signal is sent to a controller (FIG. 12).

This infrared ray reflection switch is a ultra-speed responsive sensor which has been initialized in one second after power is ON and then detecting operation is started, with a significantly improved detection speed as compared to the conventional detecting device of this type.

Figure 8:
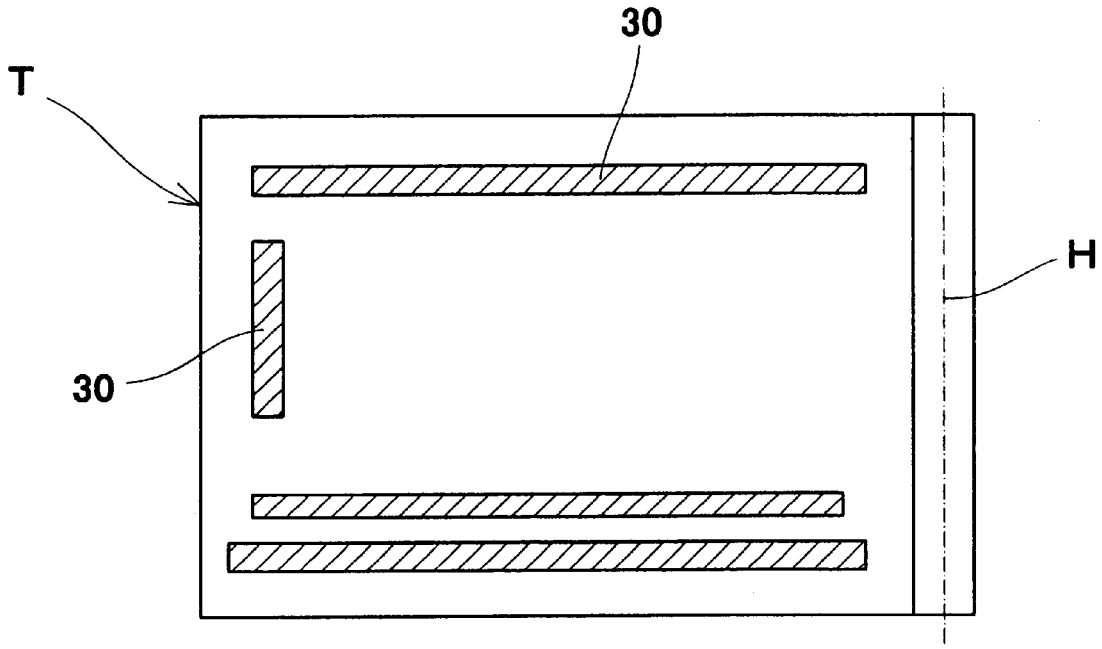
FIG. 8 is a plan view showing placement of touch switches provided on a rear face of the trap door according to the embodiment of the present invention.

Referring to FIG. 8, band-shaped touch switches 30 are respectively provided on three sides of the lower face (rear face) of the trap door. The band-shaped touch switches will not be explained in detail because they are well known. Any switch may be adopted as long as it is partially deformed when it touches something and electrically detects such deformation. In most of the cases where the rear face of the trap door T touches a person in the middle of the steps R, an edge thereof touches the person. Therefore, the provision of the touch switches 30 on the three sides enables the system to detect this with reliability. The control of the electric motor 2 (more precisely the drive circuit of the electric motor 2), the sliding door D and the alarm device is carried out by the control system containing the above-mentioned controller. FIG. 12 shows an a functional block diagram of this control system. Therefore, the provision of the touch switches 30 on the three sides enables the system to detect this with reliability.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A powered trap door device for a vehicle including a trap door hinged at a floor of a vestibule with steps of the vehicle and a sliding vehicle door, comprising:

a screw driving mechanism that opens/closes the trap door including an electric motor and an electromagnetic brake for driving said screw driving mechanism;

a first limit switch for detecting opening of the sliding door of the vehicle;

a second limit switch for detecting closing of the trap door, the trap door being openable only when the sliding door is opened and the sliding door being closable only when the trap door is closed; and a sensor of a periphery monitoring system provided on the vestibule to check safety of a peripheral area of the trap door, wherein the trap door can be opened/closed by the electric motor with the electromagnetic brake after the periphery monitoring system has checked safety.

2. The powered trap door device for a vehicle of claim 1, wherein the electromagnetic brake of the electric motor with the electromagnetic brake is of an unexcitation operation type.

3. The powered trap door device for a vehicle of claim 1, wherein a driving circuit of the electric motor with the electromagnetic brake is provided with an excess current detecting circuit to shut off a driving current of the electric motor when an excess current is detected.

4. The powered trap door device for a vehicle of claim 1, wherein the sensor of the periphery monitoring system is a photoelectric switch and an infrared ray reflection switch, further comprising an alarm device provided on the vestibule for being activated by a detection signal from the periphery monitoring system.

5. The powered trap door device for a vehicle of claim 1, further comprising auxiliary control switches of the electric motor with the electromagnetic brake that are provided on inside and outside of the vehicle for each vestibule.

6. The powered trap door device for a vehicle of claim 1, further comprising touch switches provided on three sides of a lower face of the trap door, wherein when any of the touch switches is turned ON, the trap door stops closing and is driven to move back to an opened position.

7. The powered trap door device for a vehicle of claim 1, wherein a driving circuit of the electric motor with the electromagnetic brake is provided with an excess current detecting circuit to stop closing operation of the trap door and to drive the trap door to automatically move to an opened position when an excess current is detected.

8. A powered trap door device for a vehicle including a trap door hinged at a floor of a vestibule with steps of the vehicle and a sliding vehicle door, comprising:

driving means for the trap door in which a sector wheel concentric with a pivot of the hinge thereof is provided on a lower face of the trap door and driven by an electric motor with an electromagnetic brake;

a first limit switch for detecting opening of the sliding door of the vehicle;

a second limit switch for detecting closing of the trap door, the trap door being openable only when the sliding door is opened and the sliding door being closable only when the trap door is closed; and a periphery monitoring system provided on the vestibule to check safety of a peripheral area of the trap door, wherein the trap door can be opened/closed by the electric motor with the electromagnetic brake after the periphery monitoring system has checked safety.

9. A powered trap door device for a vehicle including a trap door hinged at a floor of a vestibule with steps of the vehicle and a sliding vehicle door, comprising:

a pneumatic cylinder with a brake as driving means of the trap door;

a first limit switch for detecting opening of the sliding door of the vehicle;

a second limit switch for detecting closing of the trap door, the trap door being openable only when the sliding door is opened and the sliding door being closable only when the trap door is closed, the pneumatic cylinder with the brake being driven to open/close the trap door; and a periphery monitoring system provided on the vestibule to check safety of a peripheral area of the trap door, wherein the trap door can be opened/closed by the pneumatic cylinder with the brake after the periphery monitoring system has checked safety.

* * * * *